US009307877B2

(12) United States Patent
Rubio et al.

(10) Patent No.: US 9,307,877 B2
(45) Date of Patent: Apr. 12, 2016

(54) TOILET SEAT LOCKING ASSEMBLY AND METHOD

(71) Applicant: Toilet Titan, Inc., Wilson, NC (US)

(72) Inventors: Alberto Isaac Rubio, Wilson, NC (US); Aaron Dickens Meares, Smithfield, NC (US)

(73) Assignee: Toilet Titan, Inc., Wilson, NC (US)

( * ) Notice: Subject to any disclaimer, the term of this patent is extended or adjusted under 35 U.S.C. 154(b) by 262 days.

(21) Appl. No.: 14/193,894

(22) Filed: Feb. 28, 2014

(65) Prior Publication Data

US 2014/0259339 A1 Sep. 18, 2014

Related U.S. Application Data

(60) Provisional application No. 61/779,036, filed on Mar. 13, 2013.

(51) Int. Cl.
*A47K 13/12* (2006.01)
*A47K 13/26* (2006.01)

(52) U.S. Cl.
CPC ..... *A47K 13/26* (2013.01)

(58) Field of Classification Search
CPC ..... A47K 13/12
USPC ..... 4/237–241, 661, 300.1, 244.1–244.3
See application file for complete search history.

(56) References Cited

U.S. PATENT DOCUMENTS

| | | | |
|---|---|---|---|
| 247,237 | A | 9/1881 | Behr |
| 486,565 | A | 11/1892 | Lantz |
| 541,159 | A | 6/1895 | Fleischman |
| 1,005,678 | A | 10/1911 | Wolfe |
| 1,613,493 | A | 1/1927 | Turner |
| 1,919,621 | A | 7/1933 | D'Halloy |
| 2,562,032 | A | 7/1951 | Gutensohn |
| 4,326,307 | A | 4/1982 | Baillie |
| 4,416,048 | A | 11/1983 | Otte |
| 4,467,481 | A | 8/1984 | Ginsburg |
| 4,729,703 | A | 3/1988 | Sato |
| 4,820,096 | A | 4/1989 | Knight |
| 4,939,796 | A | 7/1990 | Pepper |

(Continued)

OTHER PUBLICATIONS

Bemis Manufacturing Company, StaTite Commercial Fastening System, availiable at http://www.bemisseats.com/sta-titesystem/ (retrieved Aug. 21, 2012).

(Continued)

*Primary Examiner* — Lori Baker
(74) *Attorney, Agent, or Firm* — Olive and Olive, P.A.

(57) ABSTRACT

The toilet seat locking assembly provides a device for anchoring a toilet seat in place. The assembly uses a double nut locking system that combines a seating nut with a locking nut assembly to significantly reduce the tendency of a bolt holding a seat on the toilet from becoming loose. The seating nut includes an interior threaded section for receiving a bolt, at least one ramp extending from the seating nut with a pilot extending from the ramp so that the pilot extends from the seating nut into a locking nut. The pilot extending from the seating nut ramp is designed to break away due to engagement with the locking nut, upon turning of the seating nut beyond a limit. The locking nut includes a threaded section for receiving the bolt. The locking nut has at least one pilot receiving slot, one ramp receiving slot, and a handle section for conveniently tightening the device and securing the seating nut and locking nut together.

18 Claims, 3 Drawing Sheets

(56) References Cited

U.S. PATENT DOCUMENTS

| | | | |
|---|---|---|---|
| 4,985,939 | A | 1/1991 | Otte |
| 5,212,840 | A | 5/1993 | Caldwell |
| 5,319,691 | A | 6/1994 | Peterson |
| D385,761 | S | 11/1997 | Nave |
| D485,163 | S | 1/2004 | Twomey |
| 2007/0107115 | A1 | 5/2007 | Roblejo |
| 2009/0276944 | A1 | 11/2009 | Hand |
| 2011/0000010 | A1 | 1/2011 | Henne |

OTHER PUBLICATIONS

The Home Depot, Toilet Tool Toilet Seat Tightening Kit, availiable at http://www.homedepot.com/p/Toilet-Tool-Toilet-Seat-Tightening-Kit-85243/202533615#.UjNMqT-Dmtg (retrieved Sep. 13, 2013).

TOILET SEAT LOCKING ASSEMBLY AND METHOD

CROSS REFERENCE TO RELATED APPLICATIONS

This application is related to and claims priority to the filing date of Provisional Application Ser. No. 61/779,036 filed Mar. 13, 2013 of the same inventors herein and entitled TOILET SEAT LOCKING ASSEMBLY AND METHOD. The disclosure of Provisional Application Ser. No. 61/779,036 is expressly incorporated herein by reference in its entirety.

FIELD OF THE INVENTION

The present disclosure relates to a device and method for securely fastening a toilet seat to a toilet.

BACKGROUND

Typical toilet seats have plastic or metal hinges and fittings to attach to a conventional porcelain toilet bowl. Over time, use of the seat often causes the fittings securing the seat to the bowl to become loose, allowing the seat to wobble under the weight of a person using the toilet. Not only is a wobbling toilet seat irritating to users, but it can also pose a safety issue. When faced with a wobbling seat, very young children, elderly, and others with stability challenges may fall or lose their balance, possibly resulting in serious injury.

Since the fittings are usually plastic, sufficiently tightening an unstable seat to remove the wobble may not be possible. Threads may be stripped or other damage may occur. Once loose or damaged, the fittings are difficult to tighten and often come loose repeatedly over time.

Additionally, tightening the seat fittings may be difficult or potentially distasteful. On a typical toilet, the component of the fittings that has to be accessed in order to tighten the seat is often located on the underside of the rim of the bowl. In many circumstances, it is difficult to position oneself in such a way as to have the mechanical advantages necessary to quickly complete the task. Given the potentially unsanitary condition of the area under the rim of the toilet bowl, a quick and easy means for installing a toilet seat and keeping it tightly fastened to the bowl is highly desirable.

Many have sought solutions to this problem. For example, U.S. Pat. No. 5,212,840 describes latches that may be attached to the underside of a toilet seat and that clamp the seat to the inside edge of a toilet bowl when the seat is in the lowered position. Installation of rubber locknuts in place of standard metal or plastic locknuts may also be used to fix a wobbling seat. However, such fixes are, at best, short term and, at worst, insufficient to actually resolve the problem.

BRIEF SUMMARY

In accordance with one exemplary embodiment, there is provided a device for anchoring a toilet seat in place. A double nut utilizes a modified jam nut along with a second nut to provide a locking effect and significantly reduce the tendency of the seat to become loose.

A more specific exemplary aspect involves a seating nut to provide a secure connection between a bolt and the underside of a toilet bowl rim and a locking nut assembly made up of a locking nut and handle for further securing the toilet seat and for providing easy installation. The seating nut includes a guided opening defined by at least one projecting funnel shaped top to simplify aligning the bolt within the nut as well as to center and secure the seating nut against the underside bolt opening of the rim of the toilet. An opening is defined by an interior threaded section of the seating nut for receiving the bolt and at least one projecting piece, or pilot and ramp, extending from the seating nut designed to fit into the locking nut, and to break away upon connecting and turning the seating nut, which is connected to the locking nut assembly. The locking nut assembly includes an opening defined by a threaded section for receiving the bolt, with a locking nut having at least one pilot receiving slot and at least one ramp receiving slot, and a handle section for conveniently tightening the device through engagement with the locking nut.

BRIEF DESCRIPTION OF THE DRAWINGS

Having briefly described certain embodiments of the invention, the same will be further understood from the following description made with reference to the appended drawings, wherein.

DETAILED DESCRIPTION

An inventive embodiment of a toilet seat locking assembly 100 is a device providing a double-nut lock for attaching a toilet seat 520 to a toilet bowl 500 (not shown) in a manner such as to greatly reduce seat loosening or detachment. Additionally, the toilet seat locking assembly 100 greatly minimizes the installer's exposure to the potentially unsanitary environment around and beneath the rim 510 of the toilet bowl 500.

The toilet seat locking assembly 100 of an embodiment of the invention is described with respect to the accompanying FIGS. 1-9. As will be readily appreciated, the description of a specific embodiment is not intended to be limiting to the broad scope of the invention.

Figure 1:
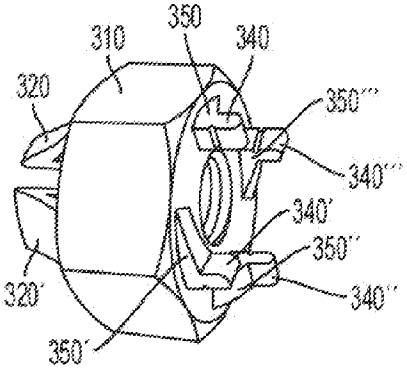
FIG. 1 is a perspective view of an embodiment of the seating nut.
Figure 2:
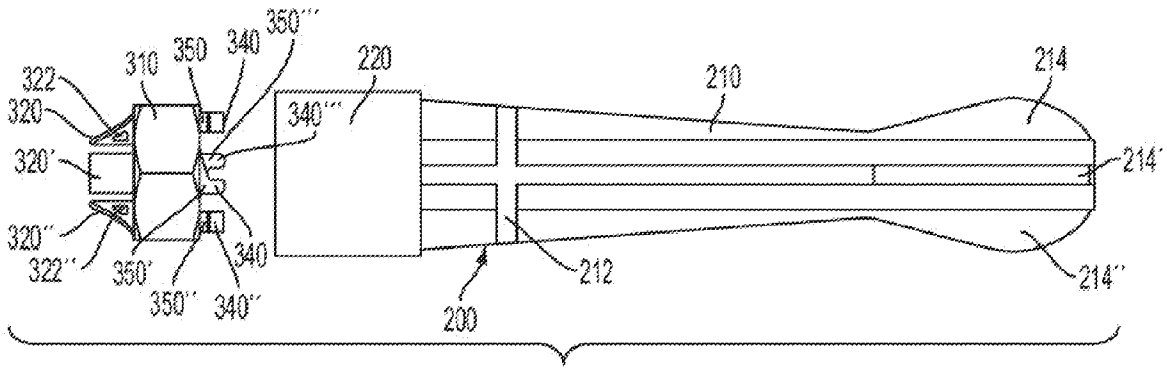
FIG. 2 is a side view of an embodiment of the toilet seat locking system including the embodiment of the seating nut depicted in FIG. 1, showing the seating nut and locking nut assembly disconnected from one another.
Figure 3:
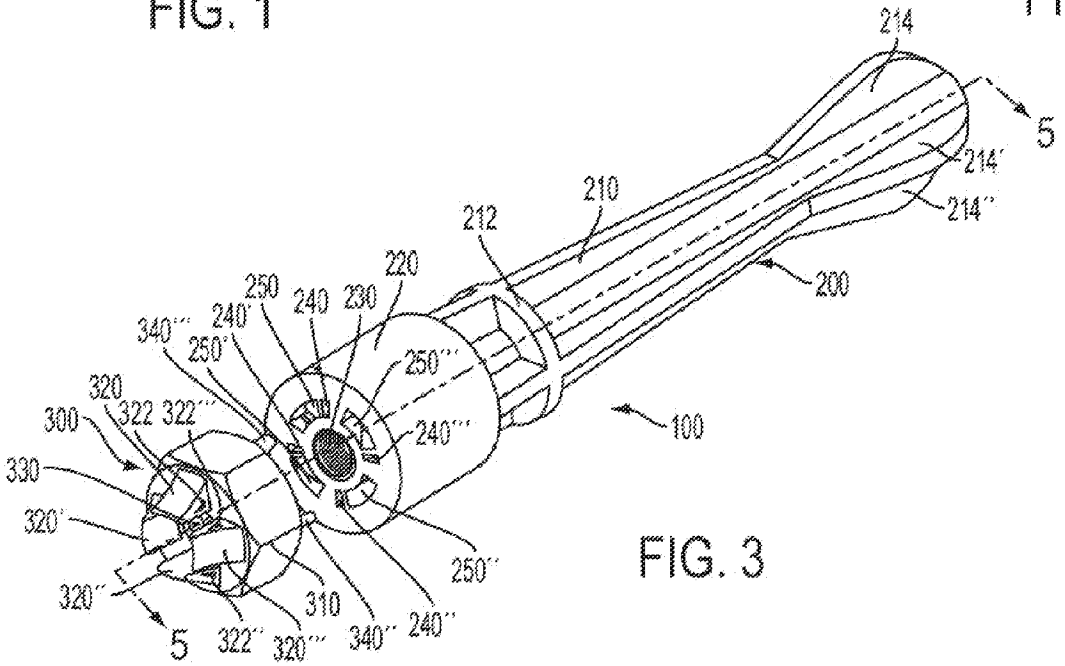
FIG. 3 is a perspective view of the embodiment depicted in FIG. 2, showing the seating nut and locking nut assembly disconnected from one another.
Figure 4:
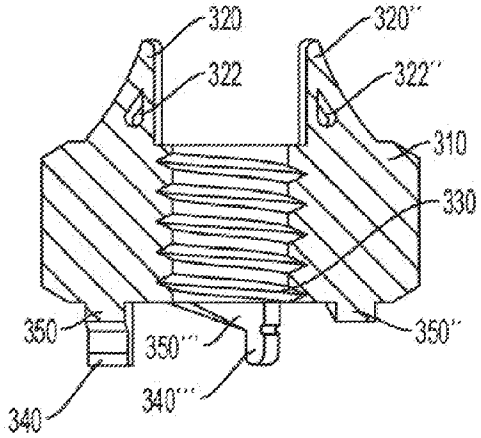
FIG. 4 is a cutaway view of the embodiment of the seating nut depicted in FIG. 1.
Figure 5:
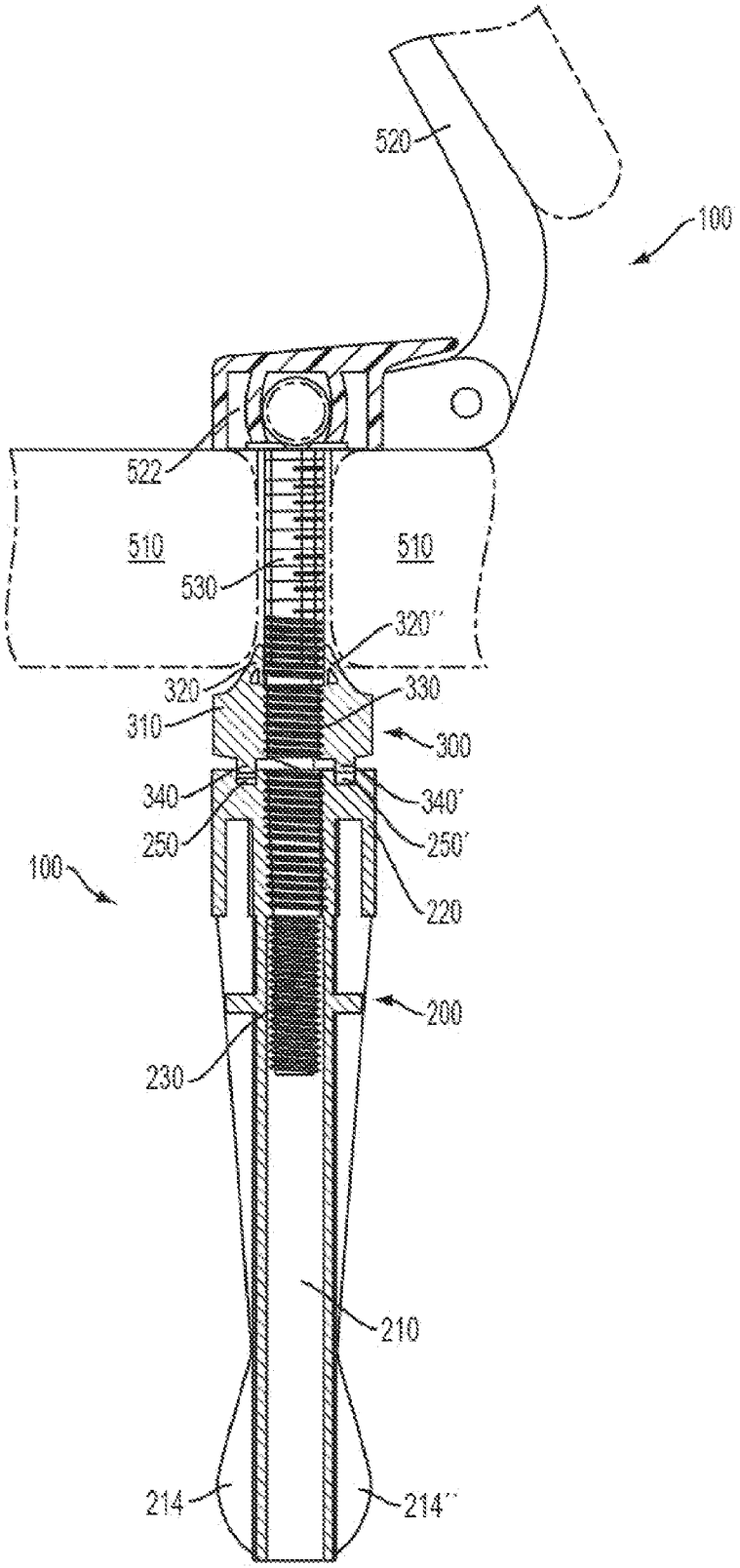
FIG. 5 is a cutaway view of the embodiment depicted in FIG. 1 used to install a toilet seat.
Figure 7:
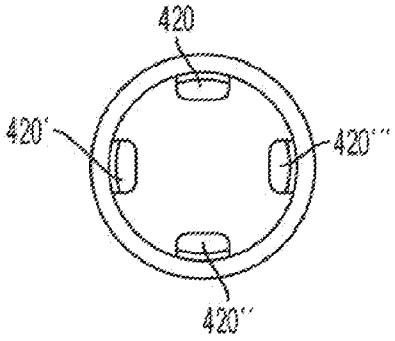
FIG. 7 is a top view of the embodiment of the cover depicted in FIG. 5.
Figure 9:
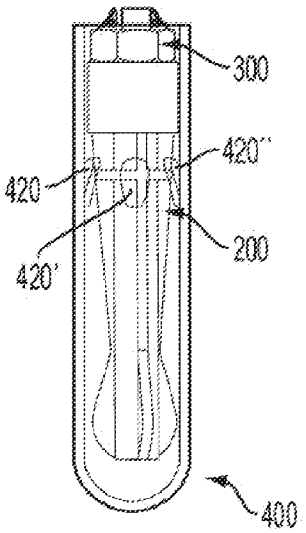
FIG. 9 is an exterior perspective view of the embodiment of the cover shown in FIG. 5 as it is fully seated over the connected seating nut and locking nut assembly.
Figure 6:
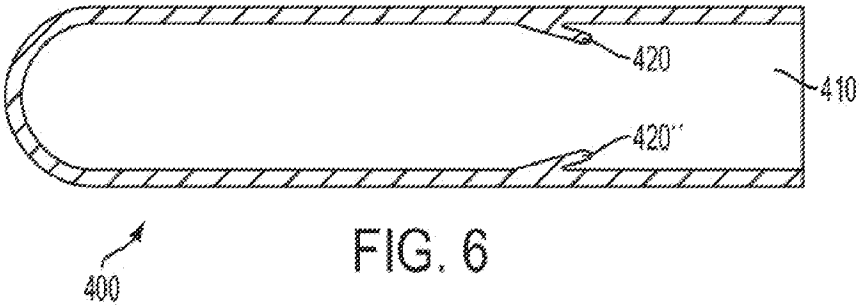
FIG. 6 is a cutaway view of an embodiment of a cover for the toilet seat locking system.
Figure 8:
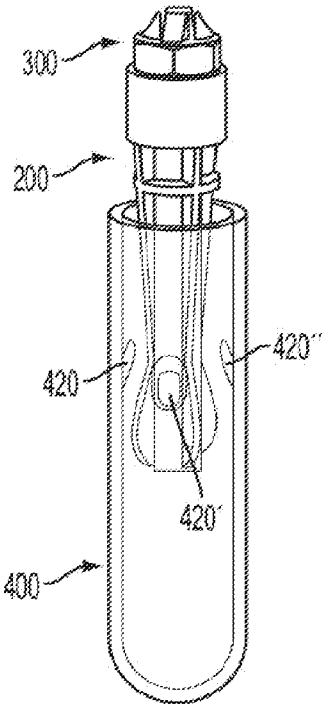
FIG. 8 is an exterior perspective view of the embodiment of the cover shown in FIG. 5 as it is sliding over the connected seating nut and locking nut assembly.

In the depicted embodiment, the toilet seat locking assembly 100 as shown in FIGS. 1-5, includes a seating nut 300 and a locking nut assembly 200 to provide a secure connection between, as shown in FIG. 5, a bolt 530 and the underside of a toilet bowl rim 510, and for providing easy and quick installation of the toilet seat 520.

The seating nut 300 includes a body 310 of a typical seating nut design. In the depicted embodiment, the body 310 has six sides, which is the most common shape for nuts as a hexagonal shape provides a good granularity of angles from which a user may approach the nut with a tool and not so many corners that they are especially vulnerable to being rounded off. Although the six-sided nut is typical for applications such as described herein, other shapes may also be appropriate.

The seating nut 300 further includes an interior threaded section 330 that extends through the center of the nut body 310 for receiving the bolt 530.

The seating nut 300 may also further include a funnel shaped top to simplify aligning the bolt 530 within the nut 300. In the depicted embodiment, a funnel shaped top is shown as comprising four bolt guides 320, 320', 320", 320''', preferably evenly spaced extending upward from the periphery of the threaded section 330. Together, the guides 320, 320', 320", 320''' have a fluted shape that guide the bolt 530 straight into and through the interior threaded section 330 of the nut body 310. As shown, the shape of the guides 320, 320', 320", 320''' is essentially extended right-triangles. The bolt guides 320, 320', 320", 320''' in the depicted embodiment further include teardrop shaped hollow sections 322, 322" (not shown for each guide 320, 320', 320", 320''') when viewed from the side. The hollow sections 322, 322" provide additional flexibility for the guides 320, 320', 320", 320''' so that they flex when inserted into the toilet bowl opening through which bolt 530 passes, and do not break or cause damage to the toilet bowl rim 510. The inside surface of the guides 320, 320', 320", 320''' is concave to allow passage of the bolt 530 and to prevent improper passage of and to center the bolt 530. When inserted between the guides 320, 320', 320", 320''' and through the interior threaded section 330, the bolt 530 secures the seat hinge assembly 522 to the toilet bowl rim 510 through compression.

The seating nut 300 also includes at least one pilot 340 and ramp 350 extrusion for securing the seating nut 300 to the locking nut assembly 200 during installation and for ensuring that seating nut 300 may not be tightened to the underside of the toilet bowl rim 510 by an amount which causes damage to the rim 510. In the depicted embodiment, four pilots 340, 340', 340", 340''', which are pieces extending from ramps 350, 350', 350", 350''', and which are directly connected to the nut body 310 through the ramps 350, 350', 350" 350''' on the side opposite the guides 320, 320', 320", 320''', are shown. The pilots 340, 340', 340", 340''' are designed to lock with locking nut 220 at pilot receiving slots 240, 240', 240", 240''' and to break away during installation of the toilet seat locking system 100, once the seating nut 300 is tightened a sufficient amount against the rim 510. The pilots 340, 340', 340", 340''', are extensions from the ramp's 350, 350', 350", 350''', as shown in the depicted embodiment, and include at least one ramp, and typically plural ramps 350, 350', 350", 350''' on the seating nut 300 and at least one ramp stop slot, or typically plural ramp stop slots 250, 250', 250", 250''', corresponding in number on the locking nut 220. The ramps 350, 350', 350", 350''' are shaped as 90 degree right triangles that function as stops that prevent the locking nut 220 from loosening independent of the seating nut 300 once the locking nut abuts against the seating nut 300. The dimensions of pilots 340, 340', 340", 340''' and ramps 350, 350', 350", 350''' are such that they are in line with the rim of the opening for the interior threaded section 330 of the seating nut 300. The pilots 340, 340', 340", 340''' and ramps 350, 350', 350", 350''' are situated relative to the threaded section 330 to allow the seating nut 300 to attach firmly to the locking nut assembly 200 through engagement with the locking nut 220 at the pilot receiving slots 240, 240', 240", 240''', which provides sufficient distance between the seating nut 300 and the locking nut 200 to allow clearance for the ramps 350, 350', 350", 350'''.

The locking nut assembly 200 with locking nut 220 functions as a second nut in the toilet seat locking assembly 100. For fittings that will be subject to regular or strenuous use, a double nut system is preferable to a single nut system. In a double nut system when the fitting is strained, the tensile stress between the two nuts remains constant, thus holding the nut threads in constant contact with the bolt threads and preventing self-loosening of a bolt. The double nut locking system is further enhanced by the ramps 350 and their corresponding stop slots 250, which prevent the self-loosening of the double nut action once the locking nut 220 is abutted firmly against the seating nut 300.

The locking nut assembly 200 includes an interior threaded section 230 for receiving the bolt 530, a locking nut 220, pilot slots 240, 240', 240", 240''' and ramp slots 250, 250', 250", 250''', for receiving the pilots 340, 340', 340", 240''' and ramps 350, 350', 350", and 350''', respectively therein, and a handle section 210. In the depicted embodiment, the threaded section 230 extends through the center of the locking nut 220 and into the upper portion of the handle section 210, providing at least enough room for the bolt 530 to be fully received into the locking nut assembly 200 after passing through the seat hinge assembly 522, bowl rim 510, and seating nut 300.

The locking nut 220 is a main component of the toilet seat locking assembly 100. In the depicted embodiment, the locking nut 220 is cylindrical, has a smooth exterior surface, and is connected to a handle section 210. The end of the locking nut 220 opposite the handle section 210 has at least one pilot receiving slot, and typically plural pilot receiving slots, 240, 240', 240", 240''', and at least one ramp receiving slot, and typically plural ramp receiving stop slots 250, 250', 250", 250'''. The pilots 340, 340', 340", and 340''' are extensions respectively from the end of ramps 350, 350', 350", and 350'''. The pilot receiving slots 240, 240', 240", 240''' and ramp receiving stop slots 250, 250', 250", 250''' are sized and shaped to accept the pilots 340, 340', 340", 340''' and ramps 350, 350', 350", 350''', respectively, which extend from the seating nut 300 when the toilet seat locking assembly 100 is installed.

The handle section 210 of the locking nut assembly 200 is preferably of a sufficient size and design to allow a user to comfortably and firmly grip the handle section 210 with his or her hand. In the depicted embodiment, the handle section 210 includes four grip extrusions 214, 214', 214", 214''' that extend from the exterior of the portion of the handle section 210 opposite the locking nut 220. The depicted embodiment of the handle section 210 also includes a flange 212 that extends from the center portion of the handle section 210 outward to the outer circumference of the handle section 210. The flange 212 may be used as a catch for the cover's 400 grip extrusions 414.

In order to install a toilet seat 520 to a toilet bowl 500 using the toilet seat locking assembly 100, the installer will place the toilet seat 520 on top of the toilet bowl rim 510. Openings in the seat hinge assembly 522 are then lined up with holes in the toilet bowl rim 510. The bolt 530 is then threaded through the seat hinge assembly 522 and toilet bowl rim 510.

If the seating nut 300 and locking nut assembly 200 of the toilet seat locking assembly 100 have not yet been joined, this must be done by the installer prior to inserting the bolt 530 into the toilet seat locking assembly 100 for maximum efficiency. When the pilots 340, 340', 340", 340''' are received in the pilot receiving slots 240, 240', 240", 240''', stop sides of the pilots 340, 340', 340", 340''' provide a connection between the seating nut 300 and locking nut assembly 200 as the locking assembly 100 is placed to be threaded onto the bolt 530.

When the bolt 530 is introduced into the top portion of the toilet seat locking assembly 100, it drops into the unthreaded opening defined by the bolt guides 320, 320', 320", 320'''. It is unnecessary for the installer to directly view the bolt 530 and assembly 100 in order to join them, leading to rapid and easy installation. The bolt 530 is then threaded through the toilet seat locking assembly 100, first through the seating nut 300, and then into the locking nut assembly 200. This may be accomplished by gripping and twisting the handle section 210.

Turning of the toilet seat locking assembly 100 squeezes the bolt guides 320, 320" into one opening extending through the toilet bowl rim 510 to the underside thereof. This action centers the bolt 530 within the aperture and, unlike traditional toilet seat fittings, stabilizes the fit of the seat 520, the bolt 530, and the assembly 100, due to the partial seating of the bolt guides 320, 320', 320", 320''' within the aperture on the underside of the commode or toilet and additional compression of the bolt guides 320, 320', 320", 320''' against the bolt 530. When the seating nut 300 has been fully pressed against the underside of the toilet bowl rim 510, the tension between the bolt guides 320, the bolt 530, and the aperture in the toilet bowl rim 510 is maximized. At this point, the seating nut 300 ceases to advance, preventing damage to the toilet bowl rim 510.

Once the seating nut 300 is in place, the locking nut assembly 200 continues to advance the locking nut 220 through turning of the handle section 210, causing the pilots 340, 340', 340", 340''' to break off into the pilot receiving slots 240, 240', 240", 240''' of the locking nut 220, and continues to turn, without the ability to self-loosen, by allowing the ramps 350, 350', 350", 350''' of the seating nut 300 to slide into the stops of the ramp receiving stop slots 250, 250', 250", 250''', until the locking nut 220 abuts against and firmly secures the seating nut 300 in place. These same steps may then be repeated on the other side of the toilet bowl 500 with a second toilet seat locking assembly 100.

Should the toilet seat 520 require maintenance, turning the handle section 210 allows the locking nut assembly 200 to simultaneously remove the seating nut 300. The toilet seat locking assembly 100 may be removed from the underside of the toilet bowl rim 510 by counter-clockwise turning. The assembly is removed as a unit because the ramps 350, 350', 350", and 350''' are seated inside respective ramp stop slots 250, 250', 250", and 250''', and cannot be withdrawn. The forces that prevent the self-loosening of the seating nut 300 are now employed to de-install the toilet seat locking assembly without the use of a separate tool for the seating nut 300.

The toilet seat locking assembly 100 may further include a cover 400 with an opening 410 on one end allowing the cover 400 to be slipped over the handle section 210. The cover 400 will snap into place. In the depicted embodiment shown in FIGS. 6-9, the cover includes interior clips 420, 420', 420", 420''', which are designed to flex to allow flange extrusions 212, 212', 212", 212''' of the handle section 210 to slip past and then to act as stops to secure the cover 400 over the handle section 210 once it is past the flange 212. The cover 400' may be of sufficient length to cover the seating nut 300 and the entire locking nut assembly 200. The cover 400 may be transparent, opaque, or a combination thereof. It may also be decorative in nature, displaying indicia relating to a holiday or sports team or coordinating with the decor of the bathroom in which the toilet is found. The cover's primary function is to keep the handle clean until the device is removed. The second is for aesthetic reasons, i.e. "cleaner, neater" look. The cover may also come in colors to match the color of the commode or toilet if it is not white.

In embodiments as disclosed herein in an exemplary manner, it is envisioned that the different parts of the device, including the seating nut and locking nut, may be made of different materials, which are all readily available and well known to those skilled in the art. In alternative embodiments, an extrusion process may be used to manufacture the device as a one piece unit made of any materials which satisfy performance tolerances for the device. Thus, the invention as defined within the claims is not limited to a selection of specific materials as will be readily apparent from the description of the invention set forth herein.

The foregoing details are exemplary only. Other modifications that might be contemplated by those of ordinary skill in the art are within the scope of this invention, and the invention is not limited by the examples illustrated herein.

The invention claimed is:

1. A device for securing a toilet seat connected to a toilet bowl by a bolt, said device comprising:

a. a seating nut adapted to provide a secure connection between the bolt and an underside of a lip of the toilet bowl, said seating nut further comprising
   i. an interior threaded section adapted to receive and engage the bolt,
   ii. at least one pilot extending from at least one seating nut ramp and adapted to connect to a locking nut assembly, and designed to break away from the seating nut within the locking nut assembly;
   iii. at least one ramp extending from the seating nut adapted to engage within the locking nut assembly to secure a connection between the seating nut and the locking nut; and b. the locking nut assembly comprising:
   i. an interior threaded section adapted to receive and engage the bolt,
   ii. at least one pilot receiving slot adapted to engage at least one pilot,
   iii. at least one ramp receiving stop slot adapted to engage the at least one ramp, and
   iv. a handle section for turning the locking nut for quick and easy installation or removal.

2. The device of claim 1, in which the seating nut further comprises a fluted top configured and sized to fit between the bolt and an underside of the toilet within an aperture thereof, said fluted top extending from the seating nut on a side opposite the at least one pilot.

3. The device of claim 1, in which the fluted top comprises bolt guides.

4. The device of claim 3, in which the bolt guides comprise interior apertures to allow flexing of the guides during installation to cause centering of the bolt within the aperture.

5. The device of claim 1, in which at least one ramp comprises a portion adapted to allow the locking nut to lock into the ramp receiving stop slots once the seating nut is tightly connected to an underside of the toilet bowl.

6. The device of claim 1, in which the at least one pilot comprises a stop portion adapted to assist in securing together the seating nut and the locking nut assembly.

7. The device of claim 1, further comprising a cover to fit over the seating nut and locking nut assembly.

8. The device of claim 7, in which the cover comprises decorative indicia.

9. The device of claim 7, in which the cover is removable.

10. A device for securing a toilet seat connected to a toilet bowl by a bolt, said device comprising:

a. a seating nut adapted to provide a secure connection between the bolt and an underside of a lip of the toilet bowl, said seating nut further comprising
   i. an interior threaded section adapted to receive and engage the bolt,
   ii. a fluted top adapted to provide a secure connection between the bolt and an underside of the toilet within an aperture thereof,
   iii. at least one pilot extending from at least one seating nut ramp attached to the seating nut, and adapted to connect to a locking nut assembly, and designed to break away from the at least one seating nut ramp upon turning the handle of the locking nut assembly past a limit of the seating nut, and
   iv. at least one seating nut ramp extending from the seating nut adapted to engage within the locking nut assembly to secure a connection between the seating nut and the locking nut; and b. the locking nut assembly comprising:
   i. an interior threaded section adapted to receive and engage the bolt,
   ii. at least one pilot receiving slot adapted to engage the at least one pilot,
   iii. at least one ramp receiving stop slot adapted to engage the at least one seating nut ramp, and
   iv. a handle section adapted to turn the locking nut for quick and easy installation.

11. The device of claim 10, in which the fluted top comprises bolt guides.

12. The device of claim 11, in which the bolt guides comprise interior apertures adapted to allow flexing of the guides during installation.

13. The device of claim 10, in which the at least one pilot comprises an attachment portion adapted to assist in securing together the seating nut and the locking nut assembly.

14. The device of claim 10, in which the at least one seating nut ramp comprises a portion adapted to allow the locking nut to lock into the ramp receiving stop slots once the seating nut is connected to an underside of the toilet bowl.

15. The device of claim 10, further comprising a cover to fit over the seating nut and locking nut assembly.

16. The device of claim 15, in which the cover comprises decorative indicia.

17. The device of claim 15, in which the cover is removable.

18. A method for securely installing a toilet seat with two hinge assemblies, each having an aperture alignable with corresponding apertures in a toilet bowl, said method comprising:

a. inserting two bolts respectively through apertures in a toilet seat hinge assembly in alignment with and through apertures in a toilet bowl rim;

b. securing the bolts to an underside of the toilet bowl rim through installation of two toilet seat locking systems, said locking systems each comprising:
   i. a seating nut adapted to provide a secure connection between the bolt and an underside of a lip of the toilet bowl, said seating nut further comprising;
      1. an interior threaded section adapted to receive and engage the bolt,
      2. at least one pilot extending from a seating nut ramp attached to the seating nut, and adapted to engage within a locking nut assembly, and designed to break away from the seating nut ramp within the locking nut assembly, and
      3. at least one ramp extending from the seating nut adapted to engage within the locking nut assembly to secure a connection between the seating nut and the locking nut; and
   i. the locking nut assembly comprising:
      1. an interior threaded section adapted to receive and engage the bolt,
      2. at least one pilot receiving slot adapted to engage the at least one pilot,
      3. at least one ramp receiving slot stop adapted to engage the at least one ramp, and
      4. a handle section adapted to turn the locking nut for quick and easy installation; and c. said installation of the each of the toilet seat locking systems comprising the steps of:
   i. engaging the bolt within the interior threaded sections of the seating nut and locking nut assembly,
   ii. turning the seating nut through engagement with the locking nut assembly until the seating nut is fully seated against the underside of the toilet bowl lip and partially within the aperture in the toilet bowl rim, and the at least one pilot has broken off into the pilot receiving slot of the locking nut assembly, and
   iii. continuing to turn the locking nut with the handle past a point at which the seating nut is firmly seated, and the at least one ramp slides into the ramp receiving stop slot, with the locking nut firmly abutting and tightened against the seating nut, to be locked itself into place, in a manner incapable of self-loosening.

* * * * *